US007150515B2

(12) United States Patent
Eguchi et al.

(10) Patent No.: US 7,150,515 B2
(45) Date of Patent: Dec. 19, 2006

(54) LIQUID DELIVERING DEVICE AND LIQUID DELIVERING METHOD

(75) Inventors: Takeo Eguchi, Kanagawa (JP); Masato Nakamura, Kanagawa (JP); Toru Tanikawa, Kanagawa (JP); Minoru Kohno, Tokyo (JP); Koichi Igarashi, Kanagawa (JP); Manabu Tomita, Kanagawa (JP); Shogo Ono, Kanagawa (JP); Takaai Miyamoto, Kanagawa (JP); Iwao Ushinohama, Kanagawa (JP)

(73) Assignee: Sony Corporation, Tokyo (JP)

( * ) Notice: Subject to any disclaimer, the term of this patent is extended or adjusted under 35 U.S.C. 154(b) by 113 days.

(21) Appl. No.: 10/469,185

(22) PCT Filed: Dec. 18, 2002

(86) PCT No.: PCT/JP02/13229

§ 371 (c)(1),
(2), (4) Date: Jan. 29, 2004

(87) PCT Pub. No.: WO03/055686

PCT Pub. Date: Jul. 10, 2003

(65) Prior Publication Data

US 2004/0125168 A1 Jul. 1, 2004

(30) Foreign Application Priority Data

Dec. 27, 2001 (JP) ..... 2001-398156

(51) Int. Cl.
*B41J 2/05* (2006.01)

(52) U.S. Cl. ..... 347/56

(58) Field of Classification Search ..... 347/56, 347/51, 54

See application file for complete search history.

(56) References Cited

U.S. PATENT DOCUMENTS

| | | | | |
|---|---|---|---|---|
| 4,638,328 | A | 1/1987 | Drake et al. | |
| 5,463,413 | A * | 10/1995 | Ho et al. | 347/65 |
| 5,719,604 | A * | 2/1998 | Inui et al. | 347/54 |

FOREIGN PATENT DOCUMENTS

| | | | |
|---|---|---|---|
| JP | 02-185446 | | 7/1990 |
| JP | 2-185446 | A | 7/1990 |
| JP | 05-116317 | | 5/1993 |
| JP | 5-116317 | A | 5/1993 |
| JP | 10-181021 | A | 6/1998 |
| JP | 10-181021 | | 7/1998 |
| JP | 10181021 | A * | 7/1998 |

* cited by examiner

*Primary Examiner*—Shih-wen Hsieh
(74) *Attorney, Agent, or Firm*—Robert J. Depke; Rockey, Depke, Lyons & Kitzinger, LLC

(57) ABSTRACT

In a method and an apparatus for ejecting liquid, the processing accuracy of an ejection unit for ejecting ink can be easily increased and the variations in the volume of ink drops, the ejection angle thereof, etc., can be reduced even when dust is mixed in ink. In addition, a reduction in an ink-supply speed at which ink is supplied to an ink ejection unit can be prevented. An ink ejection apparatus includes a plurality of heating units (13) provided on a base member (11), ink cells for pressurizing ink with energy generated by the heating units (13), and nozzles (17) having ejection holes for ejecting the ink which is pressurized in the ink cells. Each of the nozzles (17) is disposed above each of the heating units (13). In addition, first open sides of the nozzles (17) which face the heating units (13) serve as ink inlets (17*b*) and second open sides of the nozzles (17) serve as the ejection holes (17*a*), so that inner spaces of the nozzles (17) serve as the ink cells, the ink cells not being provided separately.

35 Claims, 11 Drawing Sheets

LIQUID DELIVERING DEVICE AND LIQUID DELIVERING METHOD

This application claims priority to Japanese Patent Application Number JP2001-398156, filed Dec. 27, 2001, which is incorporated herein by reference.

TECHNICAL FIELD

The present invention relates to a method and an apparatus for ejecting liquid, such as ink drops, through nozzles to print an image, etc., on a print medium.

BACKGROUND ART

As an example of liquid ejection apparatuses which eject liquid from nozzles, ink jet printers are known in the art. With regard to print heads for inkjet printers, thermal print heads which eject ink using thermal energy and piezoelectric print heads which eject ink using piezoelectric elements are known in the art.

In thermal print heads, one side of ink cells is covered with a nozzle sheet having small nozzles, and heating elements are disposed in the ink cells. Ink bubbles are generated in the ink cells by rapidly heating the heating elements, and ink drops are ejected from the nozzles by a force applied by the ink bubbles.

FIGS. 15 to 18 are diagrams showing an example of a thermal print head chip a (serial type). FIG. 15 is a perspective view of the print head chip a, and FIG. 16 is an exploded perspective view of FIG. 15 where a nozzle sheet g is shown separately. In addition, FIG. 17 is a plan view showing the detailed relationship between an ink cell b (barrier layer f), a heating element c, and a nozzle h. In FIG. 17, the nozzle h is shown by double-dotted chain lines on the heating element c. In addition, FIG. 18 is a sectional view of FIG. 17 cut along line A—A, where the nozzle sheet g is also shown.

In the print head chip a, a base member d includes a semiconductor substrate e composed of silicon or the like and heating elements c formed on one side of the semiconductor substrate e by deposition. The heating elements c are electrically connected to an external circuit via conductors (not shown) formed on the semiconductor substrate e.

A barrier layer f is composed of, for example, a light-curing dry film resist, and is constructed by laminating the dry film resist on the surface of the semiconductor substrate e, on which the heating elements c are formed, over the entire region thereof and removing unnecessary parts by a photolithography process.

In addition, the nozzle sheet g has a plurality of nozzles h and is formed of, for example, nickel, by using an electroforming technique. The nozzle sheet g is laminated on the barrier layer f such that the nozzles h are positioned in accordance with the heating elements c, that is, such that the nozzles h are positioned directly above their respective heating elements c.

Ink cells b are constructed of the semiconductor substrate e, the barrier layer f, and the nozzle sheet g, such that the ink cells b surround their respective heating elements c. More specifically, in the figure, the semiconductor substrate e serves as the bottom walls of the ink cells b, the barrier layer f serves as the side walls of the ink cells b, and the nozzle sheet g serves as the top walls of the ink cells b. Accordingly, the ink cells b are open at the right front sides thereof in FIGS. 15 and 16, and are communicating with an ink path i via the open sides thereof. Ink is supplied to the ink cells b only through these open sides, and is ejected from the nozzles h, which are the only openings in the ink cells b except for the open sides.

Normally, a single print head chip a includes hundreds of heating elements c and ink cells b containing the heating elements c. The heating elements c are selected in accordance with a command issued by a controller of a printer, and ink contained in the ink cells b corresponding to the selected heating elements c is ejected from the nozzles h.

More specifically, in the print head chip a, the ink cells b are filled with ink supplied via the ink path i from an ink tank (not shown) which is combined with the print head chip a. When a current pulse is applied to, for example, one of the heating elements c for a short time such as 1 to 3 microseconds, the heating element c is rapidly heated, and a bubble of ink vapor (ink bubble) is generated on the surface of the heating element c. Then, as the ink bubble expands, a certain volume of ink is pushed by the ink bubble. A part of the pushed ink returns to the ink path i from the corresponding ink cell b, and another part of the pushed ink is ejected from the corresponding nozzle h as an ink drop. The ink drop ejected from the nozzle h lands on a print medium such as a piece of paper.

In addition, after the ink drop is ejected, ink is supplied to the ink cell b in an amount corresponding to the ejected ink drop before the next ejection. In order to efficiently eject an ink drop instantaneously at the time of ink ejection (at as high a speed as possible), the open sides (area of L1×L2 in FIG. 18) of the ink cells b are preferably as small as possible and a pressure in the ink cells b and the nozzles h at the time of ink ejection is preferably as high as possible. However, in such a case, a path resistance which occurs when ink flows into the ink cells b increases. Accordingly, a long time is required for refilling the ink cells b and a period at which ink ejection is repeated increases.

Accordingly, the ratio of an effective area (Sn) of the open sides of the nozzles h and the area of the open sides of the ink cells b (Si=L1×L2) is set to a suitable value R(=Sn/Si). The ratio R may of course be set to a specific value (depending on the ink-ejection speed, the print precision, the print speed, etc.).

In order to maintain the size and the ejection direction of the ink drops ejected within predetermined ranges, the following conditions must be satisfied:

(1) The sum of the internal volume of the ink cells b and the internal volume of the nozzles h is within a predetermined range;

(2) Even if the pressure inside the ink cells b increases when the ink drops are ejected, the semiconductor substrate e, the barrier layer f, and the nozzle sheet g are reliably adhered to each other and ink leakage does not occur; and (3) The internal volume of the ink cells b does not change when the ink drops are ejected.

If the resolution is relatively low, such as 300 dpi, the above-described conditions can be satisfied without increasing the processing accuracy. However, when the resolution is increased to, for example, 600 dpi or 1200 dpi, ink ejection performance is affected by the accumulation of processing errors and adhesion errors.

In the above-described print head chip a, since each ink cell b has only one inlet, if this inlet is clogged with, for example, dust mixed in ink, an ink-supply speed at which ink is supplied to the ink cell b decreases and a sufficient amount of ink cannot be supplied. In addition, since the open area of the inlets of the ink cells b is normally greater than the open area of ejection holes of the nozzles h, dust particles which travel into the ink cells b through the inlets thereof cannot always pass through the ejection holes.

Accordingly, there is a risk that the dust particles will remain around the heating elements c. When the dust particles remain on the heating elements c, it becomes difficult to eject ink drops normally. In particular, as the size of the ink drops is reduced to achieve high resolution, the above-described problem becomes more severe. Thus, there is a risk that ink drops of a predetermined volume cannot be ejected and the image will be blurred.

Dust exists at every point along the path of ink. Accordingly, in order to prevent the ejection holes of the nozzles h from being clogged with dust, components which come into contact with ink must be thoroughly cleaned and various kinds of dust-removing filters must be placed at multiple positions.

However, since the amount of ink supplied to the ink cells b increases as the print speed increases, if the meshes of the dust-removing filters are too fine, ink cannot be supplied sufficiently quickly. Even if there is no problem at first, dust will collect on the dust-removing filters over time and it will become difficult for ink to smoothly pass through the dust-removing filters, and eventually, ink cannot be supplied sufficiently quickly. Thus, the print quality will be degraded (for example, the image will be blurred).

The above-described problems also occur in piezoelectric print heads.

The volume of the ink drops ejected closely relates to the internal volume of the ink cells b and that of the nozzles h, and the processing accuracy of these parts must be maintained to maintain the volume of the ink drops constant. In particular, when the volume of each ink drop ejected is large, that is, when the resolution is relatively low, the above-described processing accuracy does not have a large influence. However, when the resolution is high, the volume of ink drops ejected is extremely small, and high processing accuracy is required accordingly. Although this is technically possible, high costs are incurred in order to obtain high processing accuracy.

Accordingly, a technique has been used in which a plurality of ink drops are delivered to the same position (overwrite is performed a plurality of times) to average the ink drops delivered, so that variation caused when the ink drops are ejected and ejection failure due to dust mixed in ink become indiscernible.

Although this process is effective for improving the image quality, even when the volumes of ink drops ejected from the nozzles h and ejection angles thereof are constant and the print head chip a has absolutely no defects, printing is performed more than once and the ink drops are repeatedly delivered to the same position. Therefore, there is a problem that a long printing time is required. This contradicts to the requirements of the market for high print speed.

On the other hand, print heads for line printers in which multiple print head chips a are arranged along a print line and which do not move along the print line during printing are known in the art. In this construction, however, it is difficult to perform overwrite a plurality of times as described above.

As described above, in the known constructions, difficulties regarding processing accuracy and measures against dust are barriers to high-resolution and high-speed printing.

DISCLOSURE OF INVENTION

Accordingly, an object of the present invention is to provide a method and an apparatus for ejecting liquid wherein the processing accuracy of an ejection unit for ejecting liquid, such as ink, can be easily increased, and both high print quality and high print speed can be achieved by reducing the variations in the volume of liquid, such as ink drops, the ejection angle thereof, etc., even when dust is mixed in liquid, such as ink, and preventing a reduction in a liquid-supply speed at which liquid, such as ink, is supplied to the ejection unit.

According to the present invention, the above-described object is achieved by the following means.

According to the present invention, a liquid ejection apparatus includes a plurality of energy-generating units provided on a base member, liquid cells (for example, ink cells) for pressurizing liquid (for example, ink) with energy generated by the energy-generating units, and nozzles having ejection holes for ejecting the liquid which is pressurized in the liquid cells. Each of the nozzles is disposed above each of the energy-generating units. In addition, first open sides of the nozzles which face the energy-generating units serve as liquid inlets and second open sides of the nozzles serve as the ejection holes, so that inner spaces of the nozzles serve as the liquid cells, the liquid cells not being provided separately.

In addition, according to the present invention, in a method for ejecting liquid (for example, ink) through nozzles having election holes by pressurizing the liquid contained in liquid cells (for example, ink cells) with energy generated by a plurality of energy-generating elements provided on a base member, each of the nozzles is disposed above each of the energy-generating units, and first open sides of the nozzles which face the energy-generating units serve as liquid inlets and second open sides of the nozzles serve as the ejection holes, so that inner spaces of the nozzles serve as the liquid cells, the liquid cells not being provided separately. The liquid is pressurized in the inner spaces of the nozzles with the energy generated by the energy-generating elements and is ejected through the ejection holes.

(Operation)

According to the present invention, the nozzles are disposed above the energy-generating units and the inner spaces of the nozzles serve as the liquid cells. Accordingly, separate and independent liquid cells are not provided. In addition, the first open sides of the nozzles which face the energy-generating units serve as the liquid inlets and second open sides of the nozzles serve as the ejection holes. The liquid flows into the nozzles through the open sides which face the energy-generating units, is pressurized with the energy generated by the energy-generating units, and is ejected through the ejection holes.

In addition, according to the present invention, a liquid ejection apparatus includes a plurality of energy-generating units provided on a base member and nozzles having ejection holes for ejecting liquid (for example, ink) which is pressurized with energy generated by the energy-generating units. A liquid-flowing space with a height of H is provided between the base member and a member in which the nozzles are formed, and $H<D_{min}$ is satisfied, where $D_{min}$ is a minimum open length of the nozzles.

In addition, according to the present invention, in a method for ejecting liquid through nozzles having election holes by pressurizing the liquid in liquid cells with energy generated by a plurality of energy-generating elements which are provided on a base member, a liquid-flowing space with a height of H is provided between the base member and a member in which the nozzles are formed, and $H<D_{min}$ is satisfied where $D_{min}$ is a minimum open length of the nozzles. The liquid is pressurized in the liquid cells with the energy generated by the energy-generating elements and is ejected through the ejection holes.

(Operation)

According to the present invention, from among dust particles which enter the liquid ejection apparatus, dust particles which are larger than the height H of the liquid-flowing space cannot travel into the liquid-flowing space.

Dust particles which are smaller than the height H of the liquid-flowing space may travel into the liquid-flowing space, and enter the nozzles. However, since the minimum open length $D_{min}$ of the nozzles is greater than the height H of the liquid-flowing space, the dust particles which have traveled into the liquid-flowing space and entered the nozzles are discharged through the ejection holes when the liquid, such as ink drops, are ejected.

BEST MODE FOR CARRYING OUT THE INVENTION

Embodiments of the present invention will be described below.

First Embodiment

Figure 1:
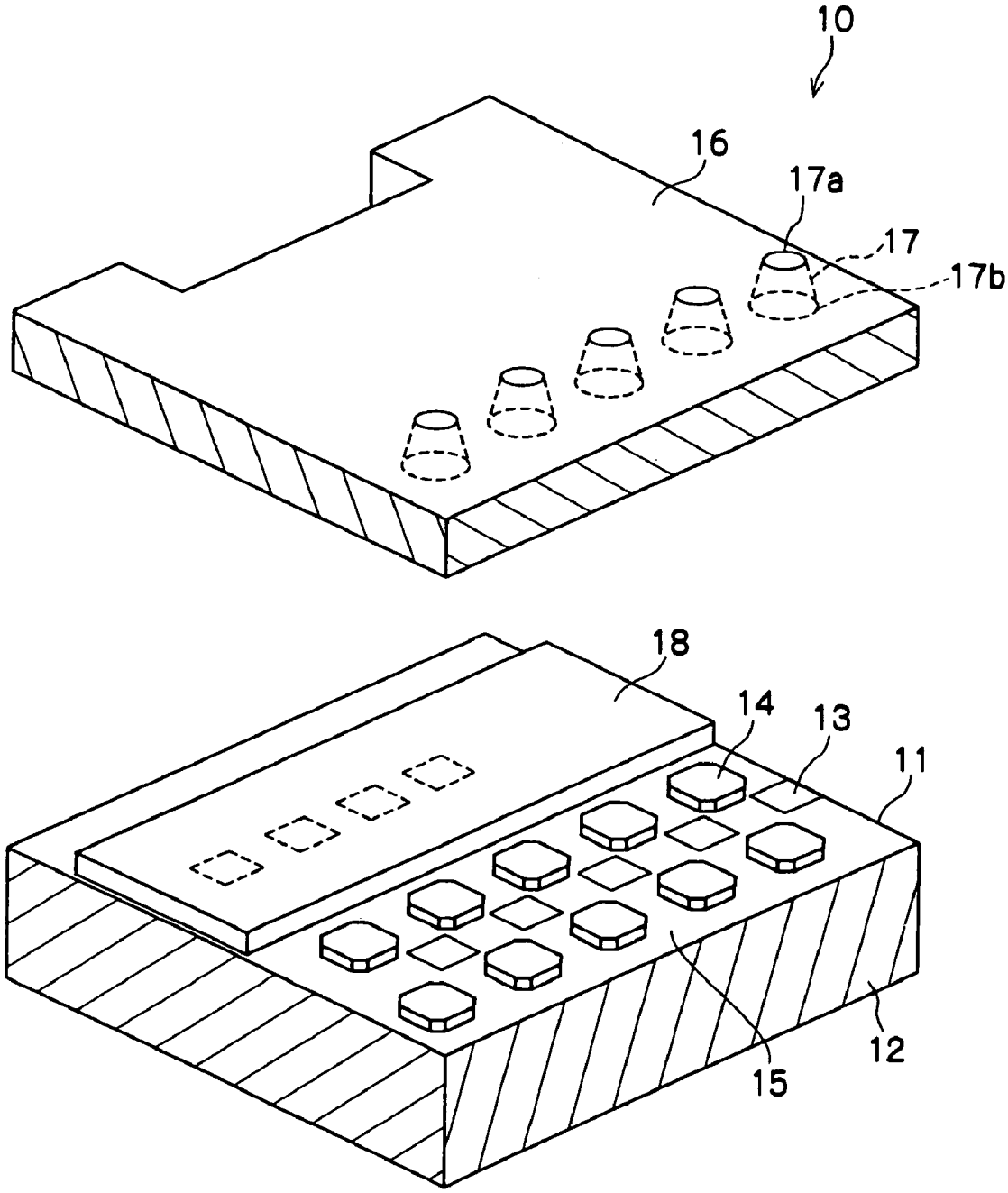
FIG. 1 is a perspective view of a print head chip incorporating an ink ejection apparatus according to the present invention, where a hollow-section-formed member is shown separately.
Figure 2:
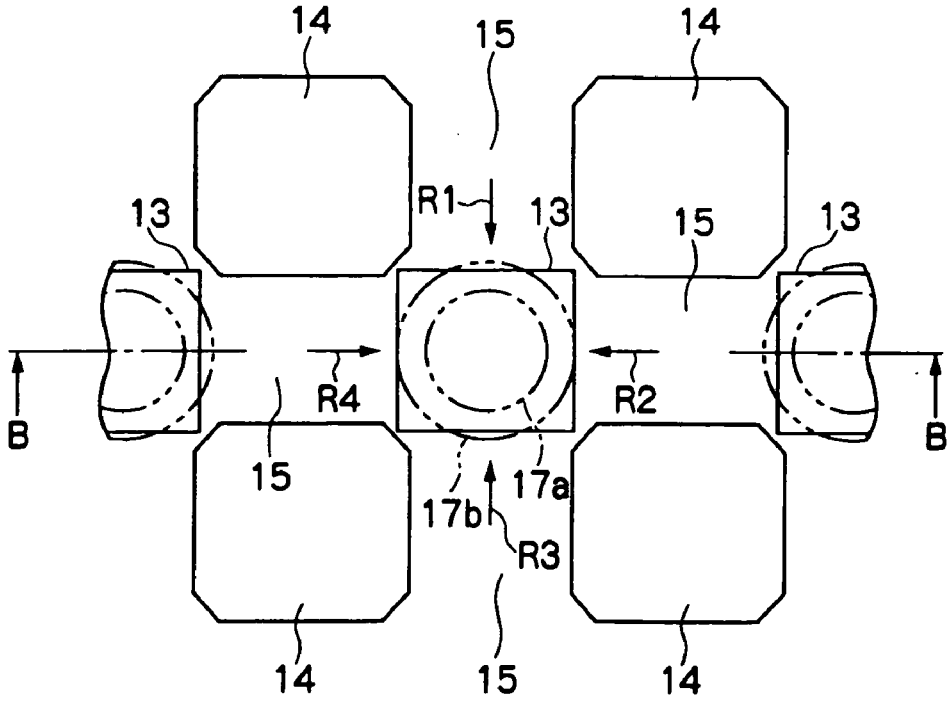
FIG. 2 is a plan view showing the detailed relationship between heating elements, support members, ejection holes, and ink inlets shown in FIG. 1.
Figure 3:
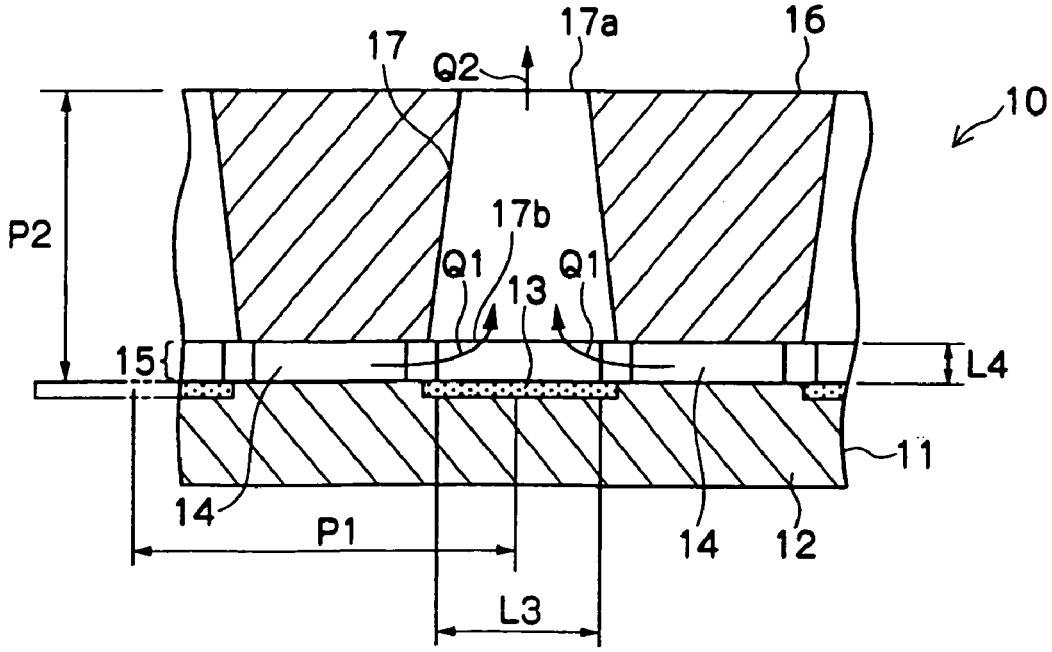
FIG. 3 is a sectional view of FIG. 2 cut along line B—B, where the hollow-section-formed member is also shown.
Figure 16:
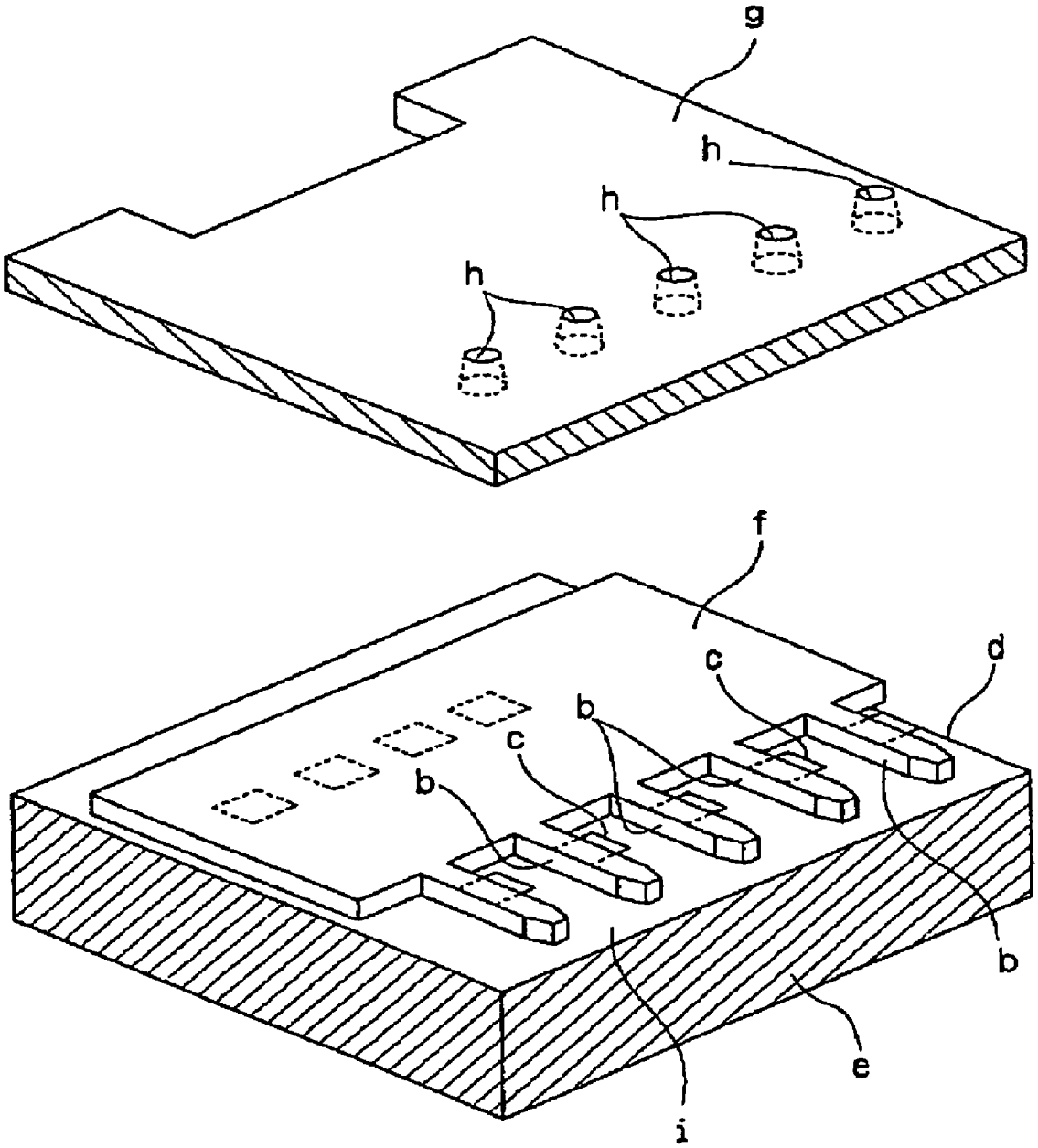
Fig.16 PRIOR ART
FIG. 16 is an exploded perspective view of FIG. 15 where a nozzle sheet is shown separately.

FIG. 1 is a perspective view showing a print head chip 10 incorporating a method and an apparatus for ejecting liquid according to the present invention, where a hollow-section-formed member 16 is shown separately. FIG. 2 is a plan view showing the detailed relationship between heating elements 13, support members 14, ejection holes 17*a*, and ink inlets 17*b* shown in FIG. 1. In FIG. 2, the ejection holes 17*a* and the ink inlets 17*b* are shown by double-dotted chain lines on the heating elements 13. In addition, FIG. 3 is a sectional view of FIG. 2 cut along line B—B, where the hollow-section-formed member 16 is also shown. FIGS. 1, 2, and 3 correspond to FIGS. 16, 17, and 18, respectively, which show the prior art.

A base member 11 includes a semiconductor substrate 12 composed of silicon or the like and heating elements 13 (which correspond to energy-generating units of the present invention) formed on one side of the semiconductor substrate 12 by deposition. A plurality of heating elements 13 are arranged on the base member 11, and are electrically connected to an external circuit via conductors (not shown) formed on the base member 11. This construction is similar to the above-described known construction.

In addition, in the first embodiment, support members 14 are arranged on the base member 11, on which the heating elements 13 are formed, at four corners of the heating element 13 such that the support members 14 surround each of the heating elements 13. The support members 14 are composed of, for example, a light-curing dry film resist, and are constructed by laminating the dry film resist on the surface of the base member 11, on which the heating elements 13 are formed, over the entire region thereof and removing unnecessary parts by a photolithography process. In the present embodiment, the support members 14 have an octagonal shape in cross section.

The height of the support members 14 is set to, for example, a quarter of the height of the ink cells b of the known construction. More specifically, when the height of the ink cells b is L2 (see FIG. 18), a height L4 of the support members 14 (see FIG. 3) satisfies L4≈L2/4.

In addition, a gap L3 between the support members 14 (FIG. 3) is approximately the same as a width L1 of the ink cells b (see FIG. 18), and is about 25 μm.

A hollow-section-formed member 16 is laminated on the base member 11 on which the heating elements 13 are formed. The hollow-section-formed member 16 is composed of, for example, a film-like material such as polyimide (PI) or a photosensitive resin, and the thickness of the hollow-section-formed member 16 is approximately the same as the total thickness of the barrier layer f and the nozzle sheet g of the known construction. For example, when the thickness of the barrier layer f is approximately 15 μm, the thickness of the nozzle sheet g is approximately 30 μm, and the thickness of an adhesive layer for adhering them is several μm, the total thickness of the barrier layer f and the nozzle sheet g is about 45 μm. Accordingly, the thickness of the hollow-section-formed member 16 is about 45 μm.

A plurality of cylindrical hollow sections (nozzles) 17 are formed in the hollow-section-formed member 16. The hollow sections 17 have a truncated cone shape (a cone with its vertex cut off, which has a trapezoidal shape in longitudinal section and a circular shape with its diameter decreasing toward the top in cross section). The hollow sections 17 serve as both the ink cells b and the nozzles h of the known construction.

More specifically, first open sides at the bottom of the hollow sections 17 serve as ink inlets 17*b* through which ink flows into the hollow sections 17, and second open sides at the top of the hollow sections 17 serve as ejection holes 17*a* through which ink is ejected. Ink flows into the hollow sections 17 through the ink inlets 17*b*, is pressurized in the hollow sections 17, and is ejected from the ejection holes 17*a*. The diameter of the ejection holes 17*a* is approximately the same as the diameter of the ejection holes of the known nozzles h, and is about 20 μm. The internal volume the hollow sections 17 is approximately the same as the sum of the internal volume of the ink cells b and the internal volume of the nozzles h of the known construction.

The hollow sections 17 may be formed in the above-described film-like material by etching, laser processing, die-cutting, etc.

Although the ink cells b and the nozzles h are attached to each other by adhesion in the known construction, in the present embodiment, the hollow sections 17 are formed integrally in a single layer. Accordingly, there are no connection lines, and sufficient strength can be obtained.

In the known construction, the volume of the ink drops ejected depends on the internal volumes of both the ink cells b and the nozzles h. Therefore, when a large number of nozzles h and ink cells b are arranged, the ink cells b and the nozzles h must be as uniform as possible. In the known construction, since there are two kinds of components, that is, the ink cells b and the nozzles h, there are two kinds of elements where errors may occur. However, in the present embodiment, the hollow sections 17, which serve as both the ink cells b and the nozzles h, are integrally formed by a single process, and the amount of error can be reduced accordingly. Therefore, even when a large number of hollow sections 17 are arranged, variation in shape between them can be reduced.

When the hollow-section-formed member 16 is placed on the base member 11 on which the heating elements 13 are formed, the hollow sections 17 are arranged above their respective heating elements 13. As shown in FIG. 2, the hollow sections 17 are arranged such that the centers of the hollow sections 17 are aligned with the centers of their respective heating elements 13.

When the hollow-section-formed member 16 is placed on the base member 11, a gap between the surface of the base member 11 (surfaces of the heating elements 13) and the hollow-section-formed member 16 is set to L4, which is the height of the support members 14. The space provided by this gap serves as an ink-flowing space 15 of the print head chip 10. More specifically, the ink-flowing space 15 includes the spaces below the hollow sections 17. The support members 14 serve to maintain the height of the ink-flowing space 15 constant. The ink-flowing space 15 communicates with an ink tank (not shown), and ink freely flows through the ink-flowing space 15. In the ink-flowing space 15, the only obstacles which impede the flow of ink are the support members 14.

As described above, the heating elements 13 are disposed in an open space, and are not enclosed in the ink cells b as in the known construction. The spaces which lie between the adjacent heating elements 13 at the shortest distance are also included in the ink-flowing space 15. Accordingly, in the ink-flowing space 15, ink can freely flow above the adjacent heating elements 13, and a construction in which ink flows through a single exclusive ink path is not used.

In the ink-flowing space 15, ink flows from four directions into each of the hollow sections 17. More specifically, as shown in FIG. 2, ink flows into each of the hollow section 17 along one of four routes R1, R2, R3, and R4 (Q1 in FIG. 3) which are provided in the ink-flowing space 15 by the support members 14 disposed at the four corners of each of the heating elements 13 so as to surround the heating element 13. Thus, four ink-flowing routes are provided for each of the hollow sections 17.

In the known construction, the open area of the inlets of the ink cells b is L1×L2. In the present embodiment, the open area of the inlets of the hollow sections 17 is 4 (number of routes)×L3×L4 (see FIG. 3). As described above, since L1=L3 and L4≈L2/4 are satisfied, the open area of the inlets of the ink cells b of the known construction is approximately the same as the open area of the inlets of the hollow sections 17 of the present embodiment.

However, according to the present embodiment, since ink can flow into each hollow section 17 along four routes, even when one of the routes is clogged with dust, the flow of ink into the hollow section 17 is not impeded.

In addition, the spaces which lie between the adjacent hollow sections 17 at the shortest distance are also included in the ink-flowing space 15. Accordingly, when, for example, the routes R1 and R3 shown in FIG. 2 are clogged with dust and sufficient amount of ink cannot flow, ink can flow along the routes R2 and R4 from the adjacent hollow sections 17, so that sufficient amount of ink can be supplied.

In addition, only dust particles which are smaller than the height L4 of the support members 14 can flow into the ink-flowing space 15, and the height L4 of the support members 14 is a quarter of the height L2 of the known ink cells b. Thus, according to the present embodiment, dust particles can be more effectively prevented from entering the ink-flowing space 15 compared to the known construction.

Although not shown in the figure, the heating elements 13 are electrically connected to an external controller with a flexible substrate, and the flexible substrate has connection tabs which are electrically connected to the heating elements 13. When a current pulse is applied to, for example, one of the heating elements 13 which is selected by a command from the controller of a printer for a short time such as 1 to 3 microseconds, the heating element 13 is rapidly heated. Prior to heating the heating element 13, the hollow sections 17 are filled with ink supplied through the ink-flowing space 15.

Accordingly, a bubble of ink vapor (ink bubble) is generated on the surface of the heating element 13. Then, as the ink bubble expands, a certain volume of ink is pushed by the ink bubble in the corresponding hollow section 17. A part of the pushed ink returns to the outside of the hollow section 17, and another part of the pushed ink is ejected from the corresponding ejection hole 17*a* as an ink drop (Q2 in FIG. 3). The ink drop lands on a print medium such as a piece of paper. Then, the hollow section 17 from which ink is ejected is immediately refilled with ink through the ink-flowing space 15 (Q1 in FIG. 3).

(Relationship Between Shock Waves Caused by Ink Ejection and Ink Ejection Control)

Next, an influence of shock waves caused by ink ejection will be described below.

In the thermal ink ejection according to the present embodiment, an instantaneous electric power necessary for ejecting a single ink drop by a single heating element 13 is relatively high, such as about 0.5 W to 0.8 W. Accordingly, when a large number of heating elements 13 are arranged as in the present embodiment and ink is simultaneously ejected from a large number of hollow sections 17, power consumption considerably increases and excessive heat is generated. Therefore, ink is not ejected from a large number of hollow sections 17 simultaneously.

When ink is ejected from the ejection holes 17*a* of the hollow sections 17 by heating the heating elements 13, shock waves are generated in ink which flows in the ink-flowing space 15. Accordingly, when ink is ejected from one of the hollow sections 17, ejection of ink from the hollow sections 17 which are adjacent to the one from which ink is ejected is not performed until the influence of the shock wave is eliminated. During this time, ink is ejected from the hollow sections 17 which are somewhat distant from the one from which ink has been ejected.

For example, the heating elements 13 are controlled such that at least the adjacent heating elements 13 are not selected as the heating elements 13 which are approximately simultaneously activated, and at least one heating element 13 is disposed between the heating elements 13 which are approximately simultaneously activated.

Accordingly, by suitably selecting the heating elements 13 which are to be activated simultaneously, the influence of the shock wave which is caused when ink is ejected from one of the hollow sections 17 on the other hollow sections 17 can be suppressed to the point where no substantial disadvantage occurs.

(Relationship Between Minimum Open Length of Hollow Sections 17 and Height L4 of Support Members 14)

In addition, according to the present embodiment, the minimum open length of the hollow sections 17 is set greater than the height L4 of the support members 14. The reason for this will be described below.

Dust particles which are small enough to travel between the support members 14 in a plan view, that is, dust particles whose width is less than L3, can travel between the support members 14. However, if the height of the dust particles is greater than the height L4 of the support members 14, the dust particle cannot travel between the support members 14 and reach positions below the hollow sections 17 (positions above the heating elements 13). As a result, the dust particles cannot enter the ink-flowing space 15.

When, for example, there are dust particles whose height is less than the height L4 of the support members 14, the dust particles may enter the ink-flowing space 15 and travel into the hollow sections 17. However, if the minimum open length ($D_{min}$) of the hollow sections 17 is greater than the height L4 of the support members 14, the dust particles which have entered the hollow sections 17 will be discharged through the ejection holes 17*a* with high probability when the ink drops are ejected. Since dust particles normally have a three-dimensional shape, the maximum shape of dust particles which can enter the hollow sections 17 can be assumed to be a cube inscribed in the hollow sections 17. Accordingly, the side length of the cube (height of the cube), that is, $D_{min}/\sqrt{2}$, is preferably set greater than the height L4 of the support members 14, so that the possibility that the dust particles which have entered the hollow sections 17 will be discharged increases. More preferably, the diagonal length of the cube, that is, $D_{min}/\sqrt{3}$, is set greater than the height L4 of the support members 14. Accordingly, ejection failure which occurs when the dust particles remain near the ejection holes 17*a* can be prevented. Thus, the influence of dust particles which enter the ink-flowing space 15 can be almost eliminated.

If the hollow sections 17 are shaped as in the present embodiment, the minimum open length is the diameter of the ejection holes 17*a*. Accordingly, the diameter of the ejection holes 17*a*, $D_{min}/\sqrt{2}$, or $D_{min}/\sqrt{3}$, may be set greater than the height L4 of the support members 14. If the shape of the hollow sections 17 is different from that of the present embodiment, the minimum open length ($D_{min}$) in the cross section of the hollow sections 17, $D_{min}/\sqrt{2}$, or more preferably, $D_{min}/\sqrt{3}$, may be set greater than the height L4 of the support members 14.

Figure 4:
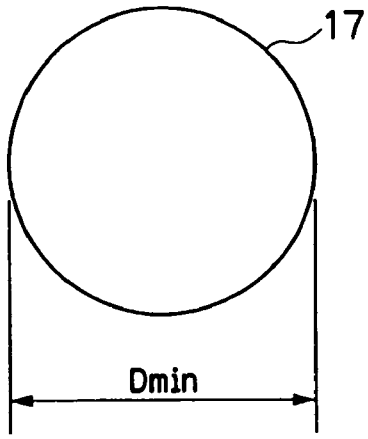
FIG. 4 is a diagram showing a hollow section whose cross sectional shape is circular.
Figure 5:
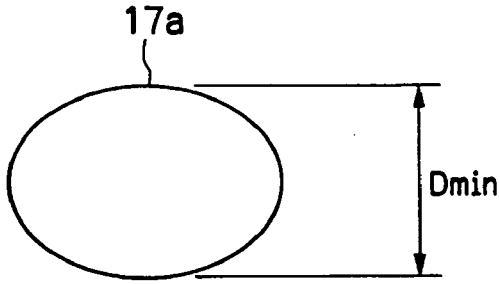
FIG. 5 is a diagram showing a hollow section whose cross sectional shape is elliptical.
Figure 6:
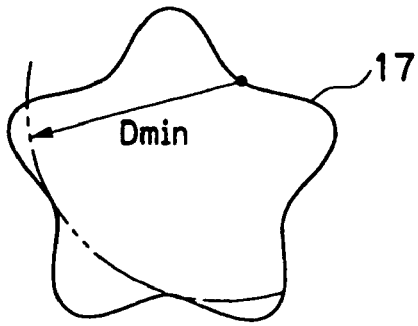
FIG. 6 is a diagram showing a hollow section whose cross sectional shape is a star-like shape.

If the cross sectional shape of the hollow sections 17 is circular as in the present embodiment, as shown in FIG. 4, the minimum open length $D_{min}$ is the same as the diameter of the circle. In addition, if the cross sectional shape of the hollow sections 17 is elliptical, as shown in FIG. 5, the minimum open length $D_{min}$ is the length along the minor axis of the ellipse. In addition, if the cross sectional shape of the hollow sections 17 is a star-like shape, as shown in FIG. 6, the minimum open length $D_{min}$ is the distance between one of the inner vertexes to another inner vertex. In any case, the effects of the present invention can be obtained when the minimum open length $D_{min}$, preferably $D_{min}/\sqrt{2}$, more preferably $D_{min}/\sqrt{3}$, is set greater than L4.

As shown in FIGS. 5 and 6, the shapes of the hollow sections 17 and the ejection holes 17*a* (and the shape of the ink inlets 17*b*) are not limited to those of the present embodiment, and various other shapes may be acceptable. For example, the cross sectional shape of the hollow sections 17 and the shapes of the ejection holes 17*a* and the ink inlets 17*b* may be any shape, such as a polygonal shape.

In addition, the present invention also provides an effect that the manufacturing yield of the print head can be increased. Although print heads are normally manufactured in a clean environment, dust particles whose size is about 10 μm still exist. In the known construction, since the size of the barrier layer f is about 15 μm, when the dust particles collect on the print head, there is a possibility that the dust particles will enter the ink path i. When the dust particles enter the ink path i and reach the base member d, since the nozzle sheet g is composed of a conductive material, such as nickel, a short circuit easily occurs between the nozzle sheet g and the base member d if the resistance of the dust particles is low. If a short circuit occurs at the base member d, the base member d will be damaged and the print head will be defective. This problem is particularly crucial when long heads having a large number of nozzles h which are used in line-head printers are manufactured. According to the present invention, even if the dust particles collect on the surface of the print head, the possibility that they will enter the ink path (that is, the ink-flowing space 15) is extremely low. Thus, the possibility that the dust particles will reach the surface of the base member 11 can be considerably reduced, so that the above-described problems can be avoided. More specifically, the filter effect provided by the ink-flowing space 15 according to the present invention serves to increase the manufacturing yield.

(Relationship Between Distance P1 Between Centers of Adjacent Heating Elements 13 and Minimum Distance P2 from Surfaces of Heating Elements 13 to Centers of their Respective Ejection Holes 17*a*)

Next, the relationship between the distance P1 between the centers of the adjacent heating elements 13 and the minimum distance P2 from the surfaces of the heating elements 13 which face the ink-flowing space 15 to the centers of their respective ejection holes 17*a* will be described below.

As shown in FIG. 3, the distance between the centers of the adjacent heating elements 13 is defined as P1 and the minimum distance from the surfaces of the heating elements 13 to the centers, of their respective ejection holes 17*a* is defined as P2.

Figure 17:
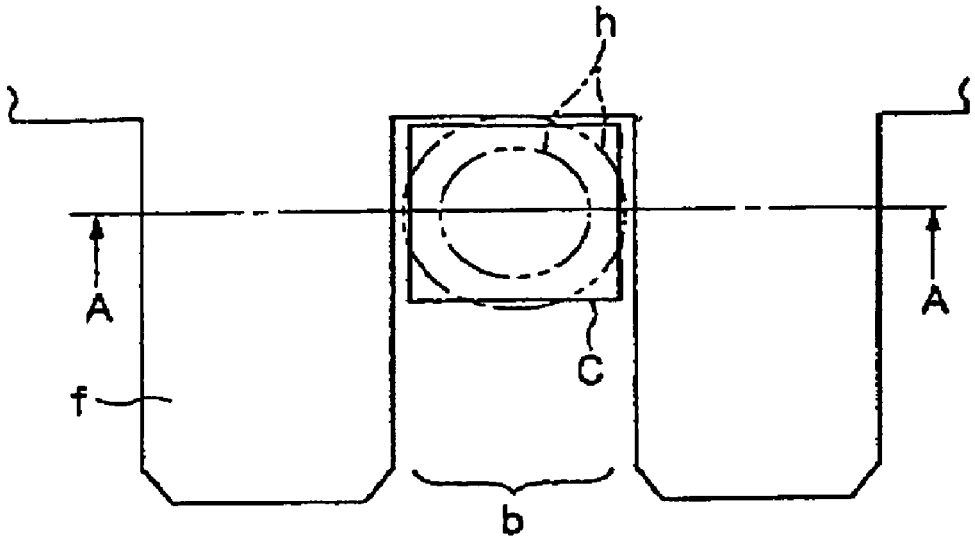
Fig.17 PRIOR ART
FIG. 17 is a plan view showing the detailed relationship between an ink cell (barrier layer), a heating element, and a nozzle.
Figure 18:
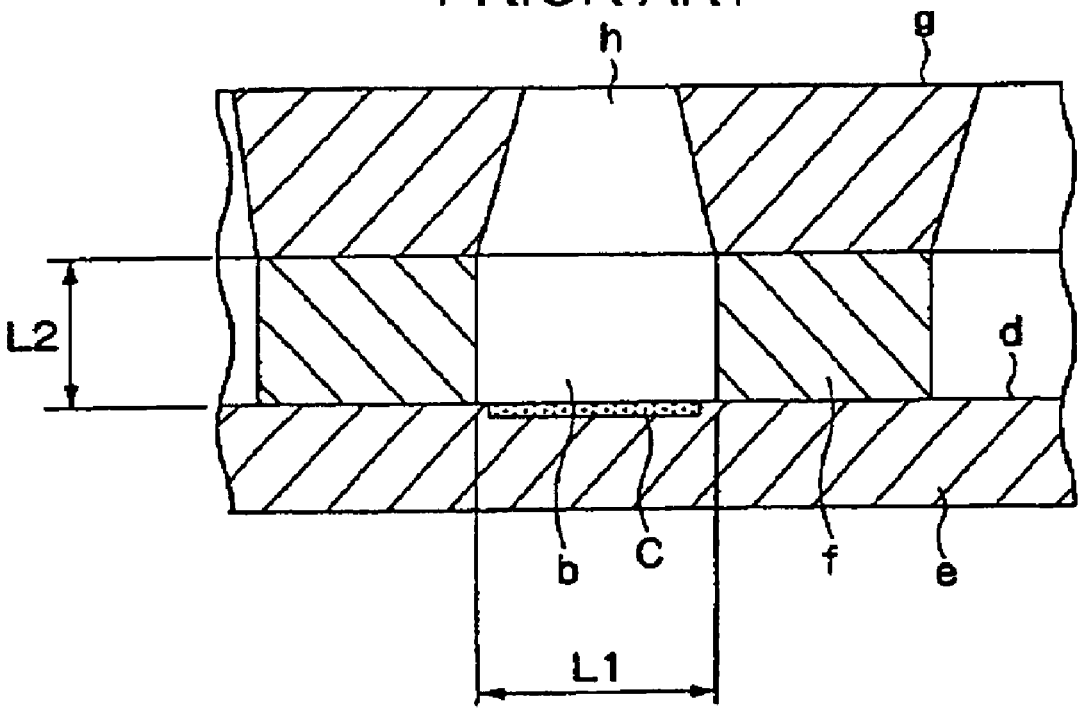
Fig.18 PRIOR ART
FIG. 18 is a sectional view of FIG. 17 cut along line A—A, where the nozzle sheet is also shown.

In the known construction, since the barrier layer f is provided as the partition walls between the heating elements c, as shown in FIG. 17, P1/P2>1 is normally satisfied.

However, in the case in which high resolution, for example, 1200 dpi, is required, the distance P1 between the centers of the heating elements 13 is small, such as approximately 20 μm. Therefore, in the known construction, there is a limit to increasing the resolution. According to the present invention, however, although the hollow sections 17 must have a certain strength and a certain height in order to obtain the structure suitable for ejecting the ink drops, high resolution can be achieved since the barrier layer f is not provided. Thus, in the present embodiment, different from the known construction, P1/P2<1 is satisfied.

(Arrangement of Support Members)

Next, the arrangement of the support members 14 will be described below.

As described above, the support members 14 shown in FIG. 1 are arranged at the four corners of the heating elements 13 so as to surround the heating elements 13. However, the arrangement of the support members 14 is not necessarily limited to this, and various modifications are possible with respect to the shape, the size, the number, the arrangement pattern, etc., of the support members 14.

FIGS. 7 to 10 are plan views showing the modifications of the arrangement of the support members 14. The positional relationship between the heating elements 13 and the support members 14 is shown in FIGS. 7 to 10, and the ejection holes 17*a* and the ink inlets 17*b* are shown by double-dotted chain lines.

Figure 7:
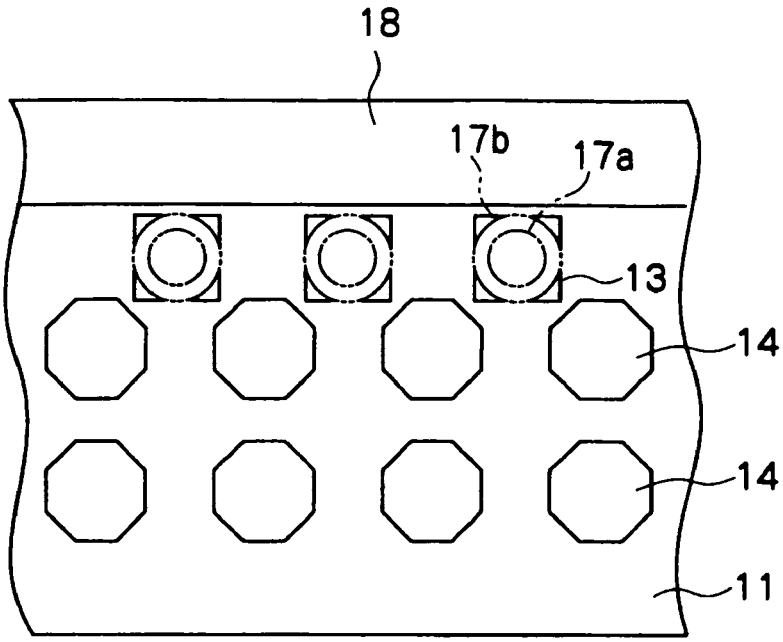
FIG. 7 is a plan view showing a first modification of the arrangement of support members.

FIG. 7 shows a first modification of the arrangement of the support members 14. In the figure, a wall 18 having the same height as the support members 14 is disposed above the heating elements 13, and the heating elements 13 are arranged along the longitudinal direction of this wall 18. The support members 14 are arranged in two lines below the heating elements 13 in the figure. More specifically, the support members 14 are arranged in two lines along the longitudinal direction at the same pitch as in FIG. 1.

Since a large number of support members 14 are arranged, the height of the ink-flowing space 15 can be maintained more constant and the strength of the support members 14 can be ensured. In addition, when the support members 14 are arranged as shown in FIG. 7, the dust particles which enter the ink-flowing space 15 are caused to stop at a line of the support members 14 which is as far from the heating elements 13 (the hollow sections 17) as possible. Accordingly, the ink-flowing space 15 can be prevented from being clogged at positions near the heating elements 13 (hollow sections 17) and ink can be uniformly supplied to the hollow sections 17. Thus, when the support members 14 are arranged in a plurality of lines, the dust particles are caught at one of the lines of the support members 14 before they travel through the ink-flowing space 15 toward the hollow sections 17.

Figure 8:
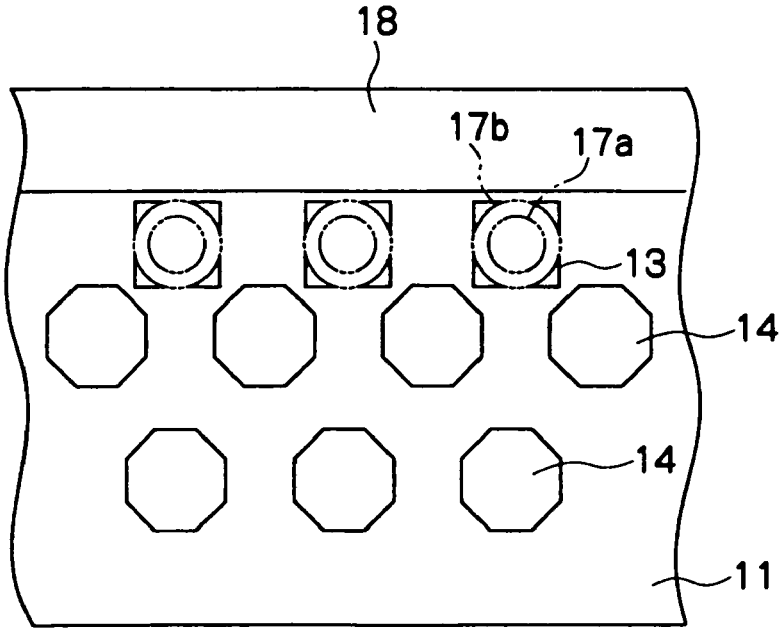
FIG. 8 is a plan view showing a second modification of the arrangement of the support members.

FIG. 8 shows a second modification of the arrangement of the support members 14. In the figure, the support members 14 are arranged in two lines such that the support members 14 on the upper line and the support members 14 on the lower line are not aligned in the vertical direction. More specifically, in the figure, the support members 14 on the upper line and the support members 14 on the lower line are shifted from each other. In this case, the dust particles can be more effectively prevented from traveling, through the support members 14 and reaching the hollow sections 17.

Figure 9:
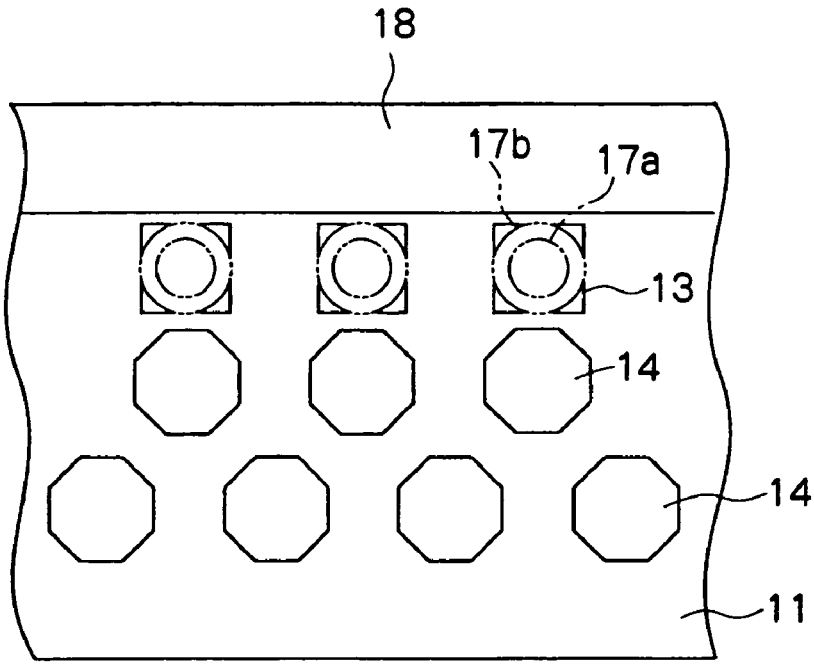
FIG. 9 is a plan view showing a third modification of the arrangement of the support members.

FIG. 9 shows a third modification of the arrangement of the support members 14. In the figure, the support members 14 are arranged in two lines, as in FIGS. 7 and 8, and the support members 14 on the upper line are positioned directly below the heating elements 13. When the support members 14 are arranged in this manner, dust particles which travel through the support members 14 on the lower line are stopped by the support members 14 on the upper line, so that the dust particles can be prevented from directly reaching positions above the heating elements 13 (positions below the hollow sections 17).

Figure 10:
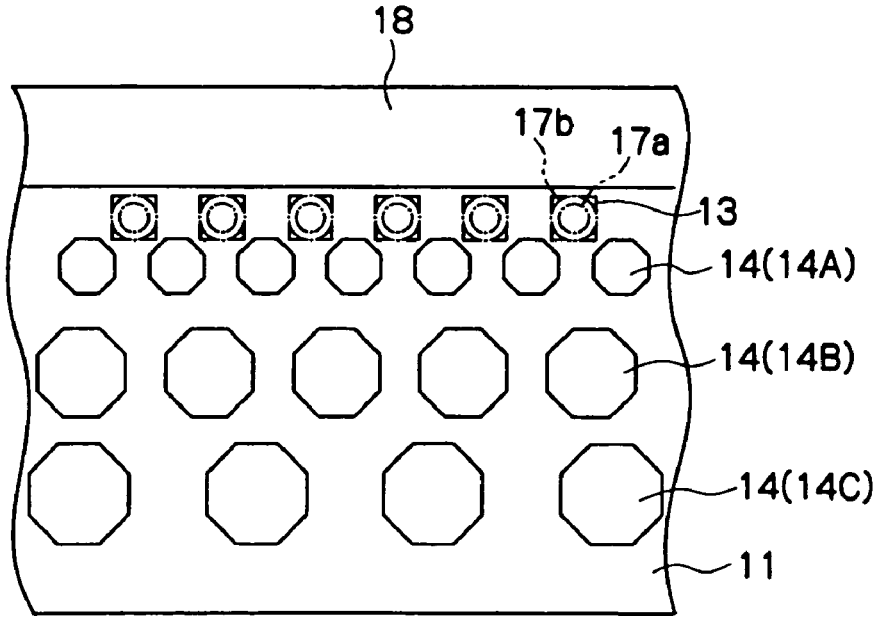
FIG. 10 is a plan view showing a fourth modification of the arrangement of the support members.

FIG. 10 shows a fourth modification of the arrangement of the support members 14, where the support members 14 are arranged in three lines. Thus, the support members 14 are not necessarily arranged in two lines, as shown in FIGS. 7 to 9, and may also be arranged in three lines, as shown in FIG. 10. In addition, the support members 14 may also be arranged in four or more lines.

Further, in FIG. 10, the support members 14 on different lines have different sizes. In FIG. 10, the size of support members 14A on the top line is the smallest, and the size of support members 14B on the central line is the second smallest. In addition, the size of support members 14C on the bottom line is the largest.

Accordingly, dust particles which are larger than the gaps between the support members 14C are stopped by the line of the support members 14 at the bottom, and do not travel further toward the heating elements 13 (hollow sections 17). In addition, from among the dust particles which travel through the gaps between the support members 14C on the bottom line, dust particles which are larger than the gaps between the support members 14B are stopped by the line of the support members 14 on the center, and do not travel further toward the heating elements 13 (hollow sections 17).

Then, from among the dust particles which travel through the gaps between the support members 14B, dust particles which are larger than the gaps between the support members 14A are stopped by the line of the support members 14 on the top, and do not travel further toward the heating elements 13 (hollow sections 17). Accordingly, as the size of the dust particles increases, the distance from the heating elements 13 (hollow sections 17) to the line of the support members 14 at which the dust particles are stopped increases.

Although the support members 14 have a columnar shape in the first embodiment, the shape of the support members 14 is of course not limited to this. For example, the heating elements 13 may also be surrounded by bracket-shaped members whose length is shorter than the length of each side of the heating elements 13. Also in this case, the ink-flowing space 15 can serve both to provide a filter effect and ensure the amount of ink which flows into the heating elements 13 to the same degree as in the known construction. In addition, it is not necessary that all of the support members 14 have the same shape. For example, the support members 14 near the heating elements 13 may be formed in a bracket shape while the other support members 14 are formed in a columnar shape.

Second Embodiment

Figure 11:
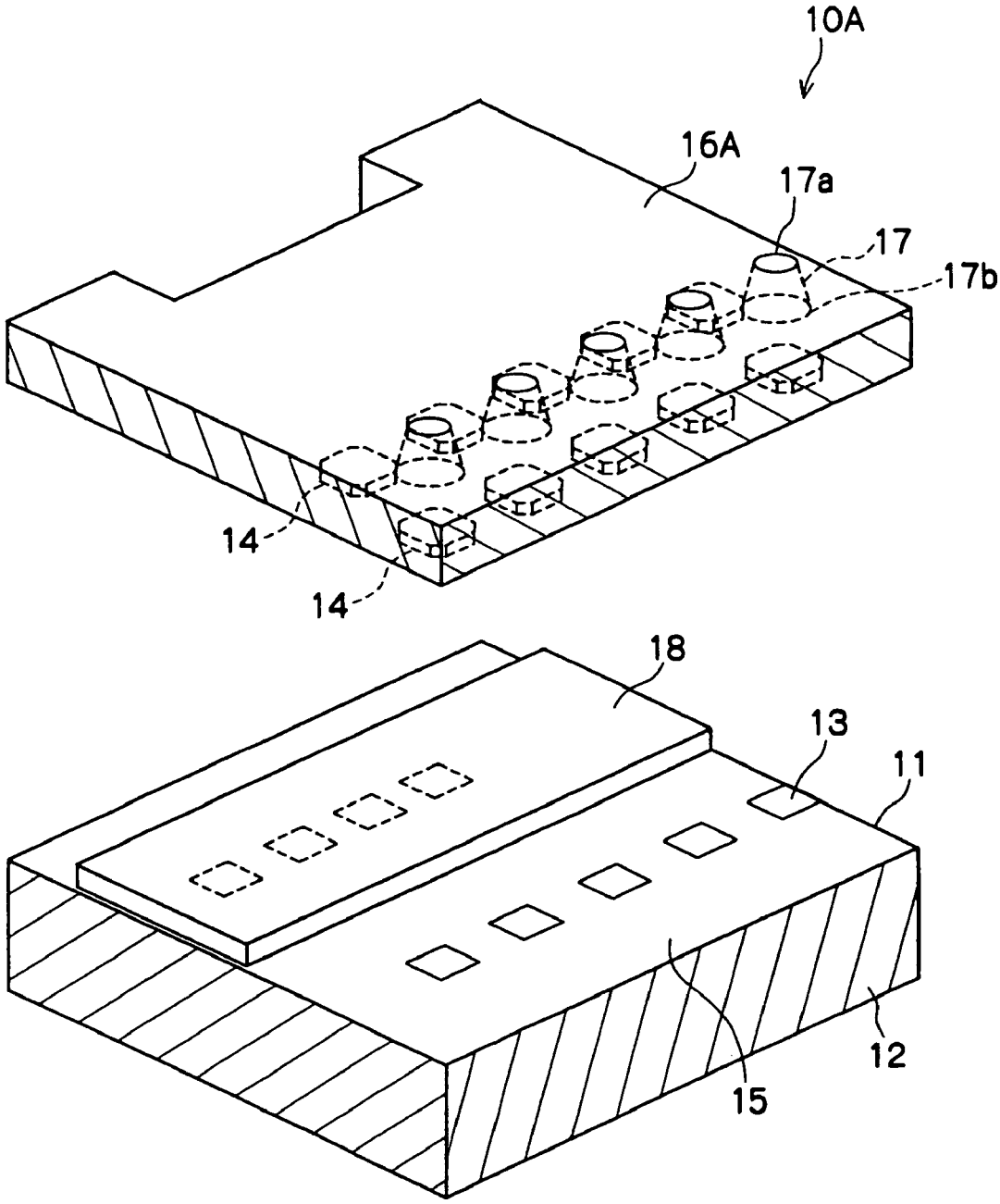
FIG. 11 is a perspective view showing a print head chip according to a second embodiment of the present invention.

FIG. 11 is a perspective view of a print head chip 10A according to a second embodiment of the present invention, where a hollow-section-formed member 16A is shown separately. FIG. 11 corresponds to FIG. 1 of the first embodiment.

In the second embodiment, although heating elements 13 are formed on a base member 11 in a manner similar to the first embodiment, support members 14 are not formed on the base member 11.

The support members 14 are formed integrally with the hollow-section-formed member 16A on the bottom surface of the hollow-section-formed member 16A in the figure. Other parts of the hollow-section-formed member 16A are similar to those of the hollow-section-formed member 16 of the first embodiment.

The support members 14 are formed on the hollow-section-formed member 16A such that they are positioned at the same positions as in the first embodiment when the hollow-section-formed member 16A is laminated on the base member 11 on which the heating elements 13 are formed.

In the case in which the hollow-section-formed member 16A is composed of a film-like material such as polyimide and a photosensitive resin, the support members 14 can be formed integrally with the hollow-section-formed member 16A by half-etching of the bottom surface of the film-like material in FIG. 1. When the hollow-section-formed member 16A is constructed in this manner, only one layer (hollow-section-formed member 16A) is provided on the base member 11, and the costs can thereby be reduced.

In addition, according to the second embodiment, only the hollow-section-formed member 16A must be laminated and adhered on the base member 11 on which the heating elements 13 are formed. Accordingly, an adhesive layer is provided at only one position. In comparison, in the first embodiment, the adhesive layer must be provided at two positions, that is, between the support members 14 and the base member 11 and between the support members 14 and hollow-section-formed member 16.

Accordingly, since the number of adhesive layers is reduced, the dimensional accuracy of the total thickness of the print head chip 10A can be increased. In addition, since the number of adhesive layers is reduced, the reliability of strength can be increased.

Other constructions are the same as those of the first embodiment, and explanations thereof are thus omitted.

In addition to the methods for forming the support members 14 used in the first and the second embodiments, the support members 14 may also be formed by printing by applying a printing layer with a thickness of L4, which is the height of the support members 14, on the surface of the base member 11 on which the heating elements 13 are formed or on the bottom surface of the hollow-section-formed member 16.

Next, an example in which a print head for a line printer is constructed will be described below.

Figure 12:
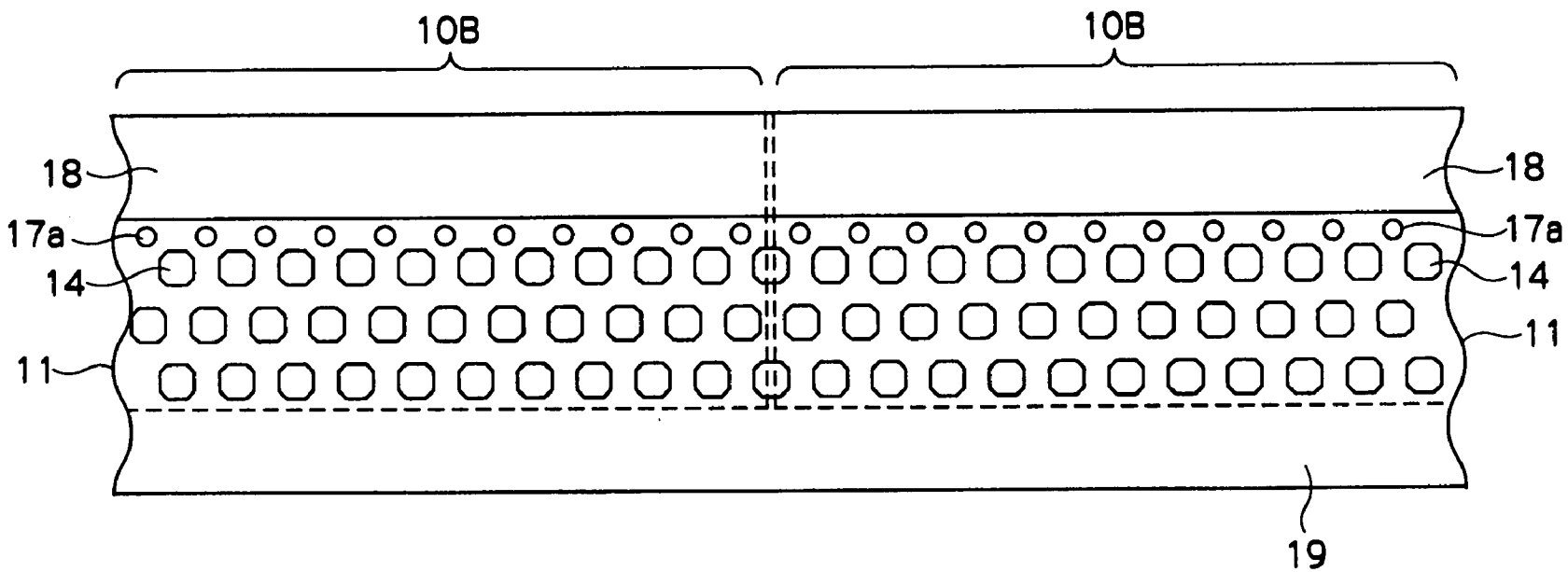
FIG. 12 is a plan view showing an example in which a print head for a line printer is constructed by arranging a plurality of print head chips.

FIG. 12 is a plan view showing an example in which a print head for a line printer is constructed by arranging a plurality of print head chips 10B. In FIG. 12, support members 14 and walls 18 are shown by bold lines.

In this example, the support members 14 are arranged in three lines in each of the print head chips 10B. In addition, in each print head chip 10B, the support members 14 are formed on the hollow-section-formed member 16A as described in the second embodiment. Accordingly, only the heating elements 13 are formed on the base members 11.

In this case, the adjacent base members 11 are disposed such that an interval between the heating elements 13 at the adjoining ends of the base members 11 is the same as the interval at which the heating elements 13 are arranged in each of the base members 11. In addition, all of the base members 11 are adhered on a single hollow-section-formed member 16A in which the hollow sections 17 are formed at positions corresponding to the heating elements 13 on all of the base members 11. In addition, a common flow path 19 for all of the print head chips 10B is provided outside the support members 14.

Accordingly, the print head for the line printer in which a plurality of the print head chips 10B are linearly arranged (the ejection holes 17*a* are linearly arranged) is obtained.

In the known construction, when multiple print head chips a are arranged, the ink ejection performance at the boundaries (ends) between the print head-chips a must be as high as that at other regions. Accordingly, the ink cells b at the boundaries between the print head chips a must be processed with high accuracy, similar to the ink cells b at the other regions. However, this is difficult. Therefore, it is difficult to eject ink with stable performance at the boundaries of the adjacent print head chips.

In comparison, according to the present embodiment, since the base member 11 has no partition walls, etc., it is only necessary to ensure the accuracy of the interval between the heating elements 13 at the boundaries between the base members 11.

The above-described print head for the line printer may also be constructed by using the print head chips 10 according to the first embodiment. Also in this case, a plurality of base members 11, on each of which the heating elements 13 and the support members 14 are formed, are laminated on a single hollow-section-formed member 16. The shapes of the support members 14 and the intervals between them at the ends of the base members 11 may be different from the shapes of the support members 14 and the intervals between them at other regions, depending on the arrangement of the support members 14. However, since the support members 14 do not directly affect the ink ejection performance like the ink cells b, no substantial disadvantage occurs even when the shapes of the support members 14 and the intervals between them are different at the boundaries of the base member 11.

Third Embodiment

Figure 13:
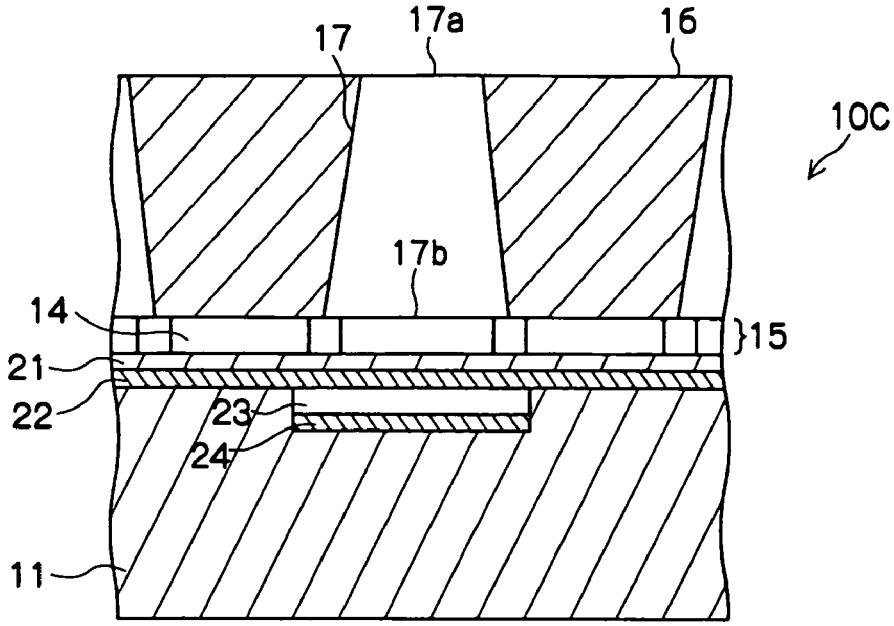
FIG. 13 is a sectional view of a print head chip according to a third embodiment of the present invention.

FIG. 13 is a sectional view showing a print head chip 10C according to a third embodiment of the present invention. FIG. 13 corresponds to FIG. 3 of the first embodiment.

In the third embodiment, a vibration plate 21, an upper electrode 22, and a lower electrode 24 are provided as the energy-generating unit in place of the heating element 13 of the first embodiment. The print head chip 10C of the third embodiment is of an electrostatic type. An air layer 23 is provided between the upper electrode 22 and the lower electrode 24. Other constructions are similar to those of the first embodiment.

In the third embodiment, when a voltage is applied between the upper electrode 22 and the lower electrode 24, the vibration plate 21 is pulled downward in the figure by an electrostatic force, and is deflected. Then, the voltage is set to 0 V so that the electrostatic force is removed. Accordingly, the vibration plate 21 returns to its original position due to the elasticity thereof, and ink contained in the hollow section 17 is ejected from the ejection hole 17*a* using the elastic force of the vibration plate 21. Also in this case, effects similar to those of the first embodiment can be obtained.

Fourth Embodiment

Figure 14:
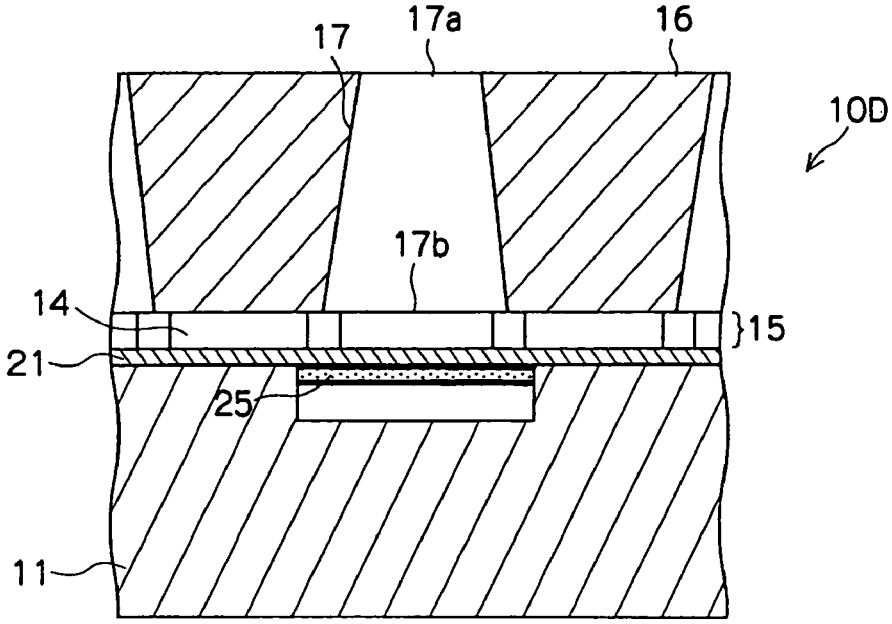
FIG. 14 is a sectional view of a print head chip according to a fourth embodiment of the present invention.
Figure 15:
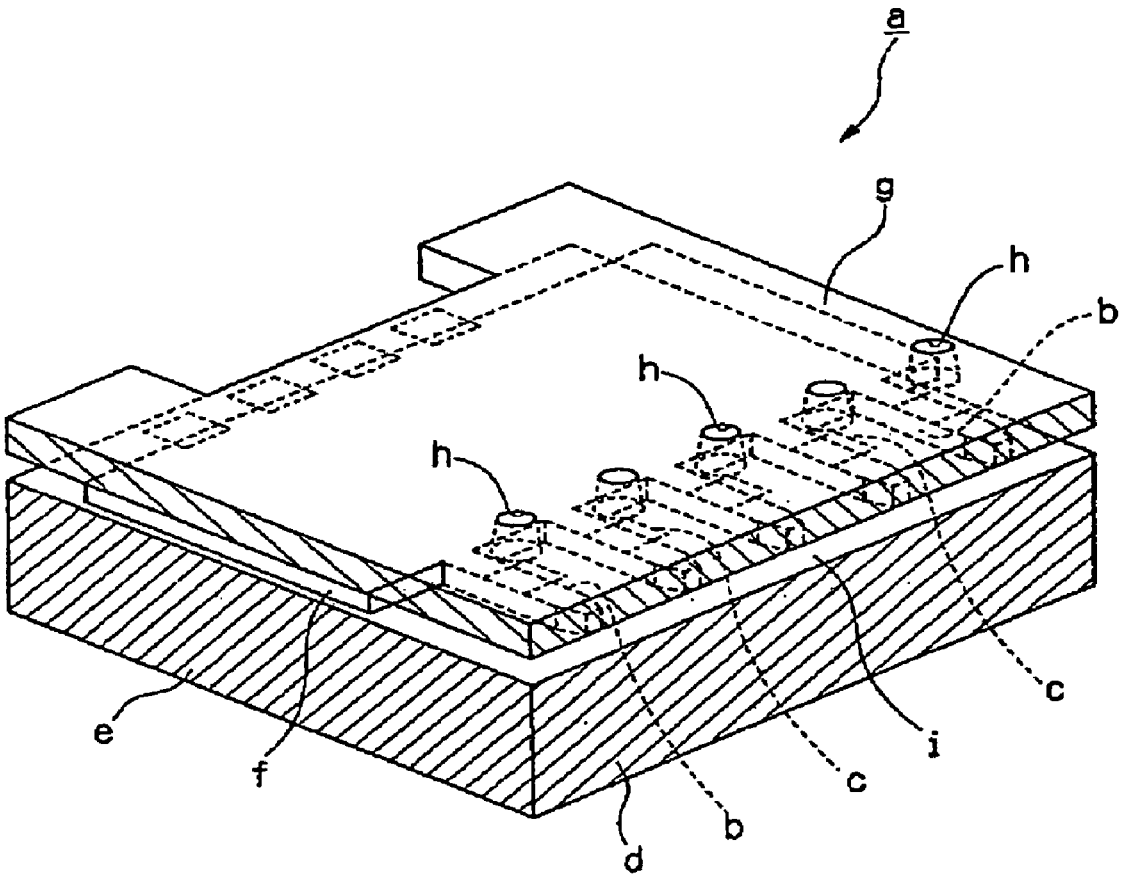
Fig.15 PRIOR ART
FIG. 15 is a perspective view showing a known print head chip.

FIG. 14 is a sectional view showing a print head chip 10D according to a fourth embodiment of the present invention. FIG. 14 corresponds to FIG. 3 of the first embodiment.

In the fourth embodiment, a laminate of a piezoelectric element 25 with an electrode layer on each side thereof and a vibration plate 21 is provided as the energy-generating unit in place of the heating element 13 of the first embodiment. The print head chip 10D of the fourth embodiment is of a piezoelectric type. Other constructions are similar to those of the first embodiment.

In the fourth embodiment, when a voltage is applied between the electrodes on both sides of the piezoelectric element 25, bending moment is applied to the vibration plate 21 due to the piezoelectric effect and the vibration plate 21 is deflected and deformed. Ink contained in the hollow section 17 is ejected from the ejection hole 17*a* using the deformation of the vibration plate 21. Also in this case, effects similar to those of the first embodiment can be obtained.

As described above, according to the present invention, the processing accuracy of the ejection unit for ejecting liquid, such as ink, can be easily increased. In addition, the variations in the volume of the liquid, such as ink drops, the ejection angle thereof, etc., can be reduced even when dust is mixed in liquid, such as ink. In addition, a reduction in a liquid-supply speed at which liquid, such as ink, is supplied to the ejection unit can be prevented.

Although the present invention can, of course, be applied to serial printers and line printers, applications of the present invention is not limited to printers, and the present invention can be applied to various methods and apparatuses for ejecting liquid. For example, the present invention can also be applied to a method and an apparatus for ejecting a DNA solution for detecting biological materials.

INDUSTRIAL APPLICABILITY

The present invention relates to a method and an apparatus for ejecting liquid, and can be applied to, for example, an inkjet printer.

The invention claimed is:

1. A liquid ejection apparatus comprising:

a plurality of energy-generating units secured to a base member;

nozzles having ejection holes for ejecting a pressurized liquid, wherein one of said nozzles is disposed above each of the energy-generating units, and wherein first open sides of the nozzles which face the energy-generating units serve as liquid inlets and second open sides of the nozzles serve as the ejection holes, so that inner spaces of the nozzles serve as the liquid cells, the liquid cells not being provided separately; and wherein the energy-generating units are aligned on the base member generally in a row, and a plurality of support members arranged generally in rows adjacent the row in which the energy-generating units are aligned, and wherein an arrangement location with reference to the energy-generating units of the support members for a row closest to the energy generating units is different from an arrangement location with reference to the energy generating units for the support members in another row.

2. A liquid ejection apparatus according to one of claim 1, wherein a plurality of the liquid ejection apparatuses are arranged such that the ejection holes of the liquid ejection apparatuses are aligned.

3. A liquid ejection apparatus comprising:

a plurality of energy-generating units secured to a base member; and a hollow-section-formed member which is disposed above the energy-generating units and in which cylindrical hollow sections are formed, first open sides of the hollow sections which face the energy-generating units serving as liquid inlets and second open sides of the hollow sections serving as ejection holes for ejecting liquid, wherein liquid flows into the hollow sections through the liquid inlets, is pressurized in the hollow sections with energy generated by the energy-generating units, and is ejected through the ejection holes, wherein the energy-generating units are aligned on the base member generally in a row, and a plurality of support members arranged generally in rows adjacent the row in which the energy-generating units are aligned, and wherein an arrangement location with reference to the energy-generating units of the support members for a row closest to the energy generating units is different from an arrangement location with reference to the energy generating units for the support members in another row.

4. A liquid ejection apparatus comprising:

a plurality of energy-generating units secured to a base member;

ejection holes for ejecting a pressurized liquid; and a hollow-section-formed member which is disposed above the energy-generating units and in which cylindrical hollow sections are formed, the hollow sections serving as both liquid cells and the ejection holes such that the liquid flows into the hollow sections through first open sides of the hollow sections which face the energy-generating units, is pressurized with energy generated by the energy-generating units, and is ejected through second open sides of the hollow sections, and wherein the energy-generating units are aligned on the base member generally in a row, and a plurality of support members arranged generally in rows adjacent the row in which the energy-generating units are aligned, and wherein an arrangement location with reference to the energy-generating units of the support members for a row closest to the energy generating units is different from an arrangement location with reference to the energy generating units for the support members in another row.

5. A liquid ejection apparatus comprising:

a plurality of energy-generating units secured to a base member;

nozzles having ejection holes for ejecting a pressurized liquid, wherein a liquid-flowing space with a height of H is provided between the base member and a member in which the nozzles are formed and the nozzles are arranged such that each of the ejection holes is placed above each of the energy-generating units, wherein first open sides of the nozzles which face the liquid-flowing space serve as liquid inlets and second open sides of the nozzles serve as the ejection holes, so that inner spaces of the nozzles serve as liquid cells, the liquid cells not being provided separately, and wherein the following expression is satisfied:

$$H<(D\min/\sqrt{2})$$

where Dmin is a minimum open length of the inner spaces of the nozzles including the ejection holes and the liquid inlets.

6. A liquid ejection apparatus comprising:

a plurality of energy-generating units secured to a base member; and a hollow-section-formed member which is disposed above the energy-generating units and in which cylindrical hollow sections are formed, first open sides of the hollow sections which face the energy-generating units serving as liquid inlets and second open sides of the hollow sections serving as ejection holes for ejecting liquid, wherein a liquid-flowing space which communicates with the liquid inlets is provided between the base member and the hollow-section-formed member, and wherein the following expression is satisfied:

$$H<(D\min/\sqrt{2})$$

where H is a height of the liquid-flowing space and Dmin is a minimum open length of the hollow sections.

7. A liquid ejection apparatus comprising:

a plurality of energy-generating units secured to a base member;

ejection holes for ejecting a pressurized liquid; and a hollow-section-formed member which is disposed above the energy-generating units and in which cylindrical hollow sections are formed, the hollow sections serving as both liquid cells and the ejection holes such that the liquid flows into the hollow sections through first open sides of the hollow sections which face the energy-generating units, is pressurized with energy generated by the energy-generating units, and is ejected through second open sides of the hollow sections, wherein a liquid-flowing space which communicates with the liquid inlets is provided between the base member and the hollow-section-formed member, and wherein the following expression is satisfied:

$$H<(D\min/\sqrt{2})$$

where H is a height of the liquid-flowing space and Dmin is a minimum open length of the hollow sections.

8. A liquid ejection apparatus according to one of claims 5 to 7, wherein the liquid-flowing space includes a space which ties between adjacent energy-generating units, from among the plurality of energy-generating units, at the shortest distance.

9. A liquid ejection apparatus according to one of claims 5 to 7, wherein the liquid-flowing space is constructed such that the liquid flows toward the energy-generating units in a plurality of different directions.

10. A liquid ejection apparatus comprising:

a plurality of energy-generating units secured to a base member;

nozzles having ejection holes for ejecting a pressurized liquid, wherein a liquid-flowing space with a height of H is provided between the base member and a member in which the nozzles are formed and one or more support members which maintain the height of the liquid-flowing space constant are arranged in a part of the liquid-flowing space, wherein the nozzles are arranged such that one of said ejection holes is placed above each of the energy-generating units, wherein first open sides of the nozzles which face the liquid-flowing space serve as liquid inlets and second open sides of the nozzles serve as the ejection holes, so that inner spaces of the nozzles serve as liquid cells, the liquid cells not being provided separately, and wherein the following expression is satisfied:

$$H<(D\min/\sqrt{2})$$

where Dmin is a minimum open length of the inner spaces of the nozzles including the ejection boles and the liquid inlets.

11. A liquid ejection apparatus comprising:

a plurality of energy-generating units secured to a base member; and a hollow-section-formed member which is disposed above the energy-generating units and in which cylindrical hollow sections are formed, first open sides of the hollow sections which face the energy-generating units serving as liquid inlets and second open sides of the hollow sections serving as ejection holes for ejecting liquid, wherein a liquid-flowing space which communicates with the liquid inlets is provided between the base member and the hollow-section-formed member, wherein the following expression is satisfied:

$$H<(D\min/\sqrt{2})$$

where H is a height of the liquid-flowing space and Dmin is a minimum open length of the hollow sections, and wherein one or more support members which maintain the height of the liquid-flowing space constant are arranged in a part of the liquid-flowing space.

12. A liquid ejection apparatus comprising:

a plurality of energy-generating units secured to a base member;

ejection holes for ejecting a pressurized liquid; and a hollow-section-formed member which is disposed above the energy-generating units and in which cylindrical hollow sections are formed, the hollow sections serving as both liquid cells and the ejection holes such that the liquid flows into the hollow sections through first open sides of the hollow sections which face the energy-generating units, is pressurized with energy generated by the energy-generating units, and is ejected through second open sides of the hollow sections, wherein a liquid-flowing space which communicates with the liquid inlets is provided between the base member and the hollow-section-formed member, wherein the following expression is satisfied:

$$H<(D\min/\sqrt{2})$$

where H is a height of the liquid-flowing space and Dmin is a minimum open length of the hollow sections, and wherein one or more support members which maintain the height of the liquid-flowing space constant are arranged in a part of the liquid-flowing space.

13. A liquid ejection apparatus according to one of claims 10 to 12, wherein the energy-generating units are aligned on the base member, and wherein a plurality of the support members are arranged along a direction in which the energy-generating units are aligned.

14. A liquid ejection apparatus according to one of claims 10 to 12, wherein the energy-generating units are aligned on the base member, wherein a plurality of the support members are arranged in a plurality of lines along a direction in which the energy-generating units are aligned, and wherein an arrangement interval of the support members on one of the lines is different from an arrangement interval of the support members on another one of the lines.

15. A liquid ejection apparatus comprising:

a plurality of energy-generating units provided on a base member;

nozzles having ejection holes for ejecting a pressurized liquid, wherein a liquid-flowing space with a height of H is provided between the base member and a member in which the nozzles are formed and one or more support members which maintain the height of the liquid-flowing space constant are formed integrally with the member in which the nozzles are formed on a side of the member which faces the liquid-flowing space, wherein the nozzles are arranged such that one of said ejection holes is placed above each of the energy-generating units, and wherein first open sides of the nozzles which face the liquid-flowing space serve as liquid inlets and second open sides of the nozzles serve as the ejection holes, so that inner spaces of the nozzles serve as liquid cells, the liquid cells not being provided separately, and wherein the following expression is satisfied:

$$H<(D\text{min}/\sqrt{2})$$

where Dmin is a minimum open length of the inner spaces of the nozzles including the ejection holes and the liquid inlets.

16. A liquid ejection apparatus comprising:

a plurality of energy-generating units secured to a base member; and a hollow-section-formed member which is disposed above the energy-generating units and in which cylindrical hollow sections are formed, first open sides of the hollow sections which face the energy-generating units serving as liquid inlets and second open sides of the hollow sections serving as ejection holes for ejecting liquid, wherein a liquid-flowing space which communicates with the liquid inlets is provided between the base member and the hollow-section-formed member, wherein the following expression is satisfied:

$$H<(D\text{min}/\sqrt{2})$$

where H is a height of the liquid-flowing space and Dmin is a minimum open length of the hollow sections, and wherein one or more support members which maintain the height of the liquid-flowing space constant are formed integrally with the hollow-section-formed member on a side of the hollow-section-formed member which faces the liquid-flowing space.

17. A liquid ejection apparatus comprising:

a plurality of energy-generating units secured to a base member;

ejection holes for ejecting a pressurized liquid; and a hollow-section-formed member which is disposed above the energy-generating units and in which cylindrical hollow sections are formed, the hollow sections serving as both liquid cells and the ejection holes such that the liquid flows into the hollow sections through first open sides of the hollow sections which face the energy-generating units, is pressurized with energy generated by the energy-generating units, and is ejected through second open sides of the hollow sections, wherein a liquid-flowing space which communicates with the liquid inlets is provided between the base member and the hollow-section-formed member, wherein the following expression is satisfied:

$$H<(D\text{min}/\sqrt{2})$$

where H is a height of the ink-flowing space and Dmin is a minimum open length of the hollow sections, and wherein one or more support members which maintain the height of the ink-flowing space constant are formed integrally with the hollow-section-formed member on a side of the hollow-section-formed member which faces the liquid-flowing space.

18. A liquid ejection apparatus comprising:

a plurality of energy-generating units secured to a base member; and nozzles having ejection holes for ejecting a pressurized liquid, wherein a liquid-flowing space with a height of H is provided between the base member and a member in which the nozzles is formed, and wherein the following expression is satisfied:

$$H<(D\text{min}/\sqrt{2})$$

where Dmin is a minimum open length of the nozzles.

19. A liquid ejection apparatus comprising:

a plurality of energy-generating units secured to a base member; and nozzles having ejection holes for ejecting a pressurized liquid, wherein a liquid-flowing space with a height of H is provided between the base member and a member in which the nozzles is formed, wherein the following expression is satisfied:

$$H<(D\text{min}/\sqrt{2})$$

where Dmin is a minimum open length of the nozzles, and wherein one or more support members which maintain the height of the liquid-flowing space constant are arranged in a part of the liquid-flowing space.

20. A liquid ejection apparatus according to claim 19, wherein the energy-generating units are aligned on the base member, and wherein a plurality of the support members are arranged along a direction in which the energy-generating units are aligned.

21. A liquid ejection apparatus according to claim 19, wherein the energy-generating units are aligned on the base member, and wherein a plurality of the support members are arranged in a plurality of lines along a direction in which the energy-generating units are aligned.

22. A liquid ejection apparatus according to claim 19, wherein the energy-generating units are aligned on the base member, wherein the energy-generating units are aligned on the base member generally in a row, and a plurality of the support members are arranged generally in rows adjacent the row in which the energy-generating units are aligned, and wherein an arrangement location with reference to the energy-generating units of the support members for a row closest to the energy generating units is different from an arrangement location with reference to the energy generating units for the support members in another row.

23. A method for ejecting liquid through nozzles having ejection holes by pressurizing a liquid in liquid cells with energy generated by a plurality of energy-generating elements which are provided on a base member, the method comprising the steps of:

providing one of said nozzles disposed above each of the energy-generating units, wherein first open sides of the nozzles which face the energy-generating units serve as liquid inlets and second open sides of the nozzles serve as ejection holes, so that inner spaces of the nozzles serve as liquid cells, the liquid cells not being provided separately, and pressurizing the liquid in the inner spaces of the nozzles with the energy generated by the energy-generating elements and ejecting the liquid through the ejection holes, wherein the energy-generating elements are aligned on the base member generally in a row, providing a plurality of support members arranged generally in rows adjacent the row in which the energy-generating units are aligned, wherein an arrangement location with reference to the energy-generating units of the support members for a row closest to the energy generating units is different from an arrangement location with reference to the energy generating units for the support members in another row.

24. A method for ejecting liquid through nozzles having ejection holes by pressurizing a liquid with energy generated by a plurality of energy-generating elements which are provided on a base member, the method comprising the steps of:

providing a liquid-flowing space with a height of H between the base member and a member in which the nozzles are formed and wherein the nozzles are arranged such one of said ejection holes is placed above each of the energy-generating units, and wherein first open sides of the nozzles which face the liquid-flowing space serve as liquid inlets and second open sides of the nozzles serve as the ejection holes, so that inner spaces of the nozzles serve as the liquid cells, the liquid cells not being provided separately, and wherein the following expression is satisfied:

$$H<(D\min/\sqrt{2})$$

where Dmin is a minimum open length of the inner spaces of the nozzles including the ejection holes and the liquid inlets, and pressurizing the liquid in the inner spaces of the nozzles with the energy generated by the energy-generating elements and ejecting the liquid through the ejection holes.

25. A method for ejecting liquid according to claim 24, wherein the provided liquid-flowing space includes a space which lies between the adjacent energy-generating units, from among the plurality of energy-generating units, at the shortest distance.

26. A method for ejecting liquid according to claim 24, wherein the provided liquid-flowing space is constructed such that the liquid flows toward the energy-generating units in a plurality of different directions.

27. A method for ejecting liquid according to claim 24, further comprising a step of providing one or more support members which maintain the height of the liquid-flowing space constant arranged in a part of the liquid-flowing space.

28. A method for ejecting liquid according to claim 27, further comprising the steps of:

wherein arranging the energy-generating units in an aligned manner on the base member, and wherein the step of providing the support members includes arranging a plurality of the support members along a direction in which the energy-generating units are aligned.

29. A method for ejecting liquid according to claim 27, further comprising the steps of:

arranging the energy-generating units in an aligned manner on the base member generally in a row, and said method further comprising the step of arranging a plurality of the support members generally in rows adjacent the row in which the energy-generating units are aligned, and such that an arrangement location with reference to the energy-generating units of the support members for a row closest to the energy generating units is different from an arrangement location with reference to the energy generating units for the support members in another row.

30. A method for ejecting liquid through nozzles having election holes by pressurizing the liquid with energy generated by a plurality of energy-generating elements which are provided on a base member, the method comprising the steps of:

providing a liquid-flowing space with a height of H between the base member and a member in which the nozzles are formed and providing one or more support members which maintain the height of the liquid-flowing space constant formed integrally with the member in which the nozzles are formed on a side of the member which faces the liquid-flowing space, arranging the nozzles such that one of said ejection holes is placed above each of the energy-generating units, and wherein first open sides of the nozzles which face the liquid-flowing space serve as liquid inlets and second open sides of the nozzles serve as the ejection holes, so that inner spaces of the nozzles serve as liquid cells, the liquid cells not being provided separately, and such that the following expression is satisfied:

$$H<(D\min/\sqrt{2})$$

where Dmin is a minimum open length of the inner spaces of the nozzles including the ejection holes and the liquid inlets, and pressurizing the liquid in the inner spaces of the nozzles with the energy generated by the energy-generating elements and ejecting the liquid through the ejection holes.

31. A method for ejecting liquid through nozzles having election holes by pressurizing the liquid with energy generated by a plurality of energy-generating elements which are provided on a base member, the method comprising the steps of:

providing a liquid-flowing space with a height of H between the base member and a member in which the nozzles are formed, such that the following expression is satisfied:

$$H<(D\min/\sqrt{2})$$

where Dmin is a minimum open length of the nozzles, and pressurizing the liquid in the liquid cells with the energy generated by the energy-generating elements and ejecting the liquid through the ejection holes.

32. A method for ejecting liquid through nozzles having election holes by pressurizing the liquid with energy generated by a plurality of energy-generating elements which are provided on a base member, the method comprising the steps of:

providing a liquid-flowing space with a height of H between the base member and a member in which the nozzles are formed, such that the following expression is satisfied:

$$H<(D\min/\sqrt{2})$$

where Dmin is a minimum open length of the nozzles, providing one or more support members which maintain the height of the liquid-flowing space constant arranged in a part of the liquid-flowing space, and pressurizing the liquid with the energy generated by the energy-generating elements and ejecting the liquid through the ejection holes.

33. A method for ejecting liquid according to claim 32, further comprising the steps of:

arranging the energy-generating units in an aligned manner on the base member, and said method further comprising the step of arranging a plurality of the support members along a direction in which the energy-generating units are aligned.

34. A method for ejecting liquid according to claim 32, further comprising the steps of:

arranging the energy-generating units in an aligned manner on the base member, and said method further comprising the step of arranging a plurality of the support members in a plurality of lines along a direction in which the energy-generating units are aligned.

35. A method for ejecting liquid according to claim 32, further comprising the steps of:

arranging the energy-generating units in an aligned manner on the base member and generally in a row, and arranging a plurality of the support members generally in rows adjacent the row in which the energy-generating units are aligned, such that an arrangement location with reference to the energy-generating units of the support members for a row closest to the energy generating units is different from an arrangement location with reference to the energy generating units for the support members in another row.

* * * * *